US005127550A

United States Patent [19]

Knorr

[11] Patent Number: 5,127,550

[45] Date of Patent: Jul. 7, 1992

[54] DEVICE FOR DISPENSING FLOWABLE MATERIAL FROM A FLEXIBLE BAG

[75] Inventor: Winfried Knorr, Hamburg, Fed. Rep. of Germany

[73] Assignee: Minnesota Mining and Manufacturing Company, St. Paul, Minn.

[21] Appl. No.: 586,897

[22] Filed: Sep. 24, 1990

[51] Int. Cl.[5] ..... B67D 5/00

[52] U.S. Cl. ..... 222/83; 222/85; 222/89

[58] Field of Search ..... 222/81, 83, 83.5, 85, 222/86, 88, 89, 105, 107, 510, 559; 206/222; 383/906

[56] References Cited

U.S. PATENT DOCUMENTS

| | | | |
|---|---|---|---|
| 4,076,147 | 2/1978 | Schmit | 222/89 |
| 4,212,373 | 7/1980 | Scragg | 222/89 |
| 4,491,631 | 4/1984 | Hosie | 222/89 |
| 4,567,999 | 2/1986 | Hjertman et al. | 222/83 |
| 4,640,425 | 2/1987 | Cabernoch | 222/107 |
| 4,776,488 | 10/1988 | Gurzan | 222/81 |
| 4,978,025 | 12/1990 | Fougeres | 222/105 |

FOREIGN PATENT DOCUMENTS

| | | |
|---|---|---|
| 0322980A1 | 7/1989 | European Pat. Off. . |
| 2525000 | 12/1976 | Fed. Rep. of Germany . |
| 3544244C2 | 6/1987 | Fed. Rep. of Germany . |

*Primary Examiner*—Michael S. Huppert
*Assistant Examiner*—Kenneth Bomberg
*Attorney, Agent, or Firm*—Gary L. Griswold; Walter N. Kirn; John C. Barnes

[57] ABSTRACT

A device for withdrawing flowable filling material through a wall of a bag having flexible walls, comprising a first member having a throughbore and an annular sealing surface surrounding the throughbore, a second member having an annular sealing surface and separating means formed radially inwardly of the sealing surface to cut a bag wall, the first and the second member including cooperating locking means which enter into an interlocking engagement when the separating means makes two cuts through the wall forming the bag. The annular sealing surfaces of the first and the second member are brought into sealing engagement to outer surface of the bag wall, whereby the first and the second member, each, are adapted to be brought into sealing engagement with the outer surface of the wall forming the bag.

17 Claims, 5 Drawing Sheets

DEVICE FOR DISPENSING FLOWABLE MATERIAL FROM A FLEXIBLE BAG

The invention refers to a device for withdrawing flowable material through a flexible wall of a bag, and in one aspect to a two piece device adherable to the bag wall for forming a dispensing opening.

PRIOR ART

Structures are known for forming a pouring or discharge opening in a flexible bag for dispensing the contents. Such structures include spouts and rupturable seals which permit access to the contents. The devices which are separate from the bag are less common. Two such devices are known from German published application 25 25 000 and 35 44 244. In each device a sealing member is placed in the bag with the contents. The sealing member in the bag and the withdrawing member include locking means, which in the second device are located radially outwardly of the sealing surface and at an axial distance therefrom such that upon mating the two, the wall of the bag is stretched before the separating means becomes effective. By means of such a withdrawing device, flowable filling material can be satisfactorily withdrawn from thick-walled and double-walled bags. The sealing member is defined by a ring member having an annular groove at the outer circumference into which locking tongues of the withdrawing member snappingly engage.

The known withdrawing device requires that, as a prerequisite, the sealing members are placed into those bags which, under some circumstances, are now emptied by the withdrawing device. For such cases, the sealing member is disadvantageous since it drops out of the bag when emptied and thus is brought into the region where the contents are poured. Particularly in connection with cast resins for electrical connections, e.g. cable connections, the discharge of a sealing member with the resin is highly undesired due to its possible negative effect on the electrical insulation.

A freely floating sealing member in the bag can be translucent which is a further disadvantage. In many cases, the filling material is dark so that the sealing member can be only detected by touch.

SUMMARY OF THE INVENTION

The present invention affords a device for forming a discharge port for withdrawing flowable material through a flexible wall of a bag.

Similar to known dispensing devices, the device according to the present invention consists of a first and a second member. In the device of the present invention, both members are located on the outer side of the associated bag walls. Further, the annular sealing surfaces are attached to the outer surfaces of the side walls of the bag by adhesion. One of the members is provided with a punch-like separating means which pierces through both bag walls when both members are pressed together, the punch-like portion thereafter engages the throughbore of the other member, leaving a passage for the flowable filling material.

The separating means, or said punch-like portion, respectively, are locked in the throughbore of the other member such that both members can be moved relative to each other. When penetrated by the separating means, both bag walls engage each other whereby only a narrow passage is left. To allow a free discharge of the flowable material through the other member or its throughbore, respectively, both bag walls have to be separated a certain distance from each other. This distance is achieved in that the first and the second element are moved away from each other until reaching a stop. Thus, the flowable material can freely enter the passage which is defined by the throughbore of the first member and the punch-like separating means of the second member.

The device according to the invention, therefore, consists of a socket and a separating means (punch) lockable within the socket, with both members being adhered to the bag wall to concurrently establish a sealing effect. The interlocking of both members can be achieved by a conventional snap connection known in a variety of modifications. It can be formed by a positive connection, e.g. a bayonet lock or the like. In both cases, it is necessary that both members can move relative to each other a limited amount in a direction opposite to the plugging direction to allow the flowable material to be discharged. Above all, the disadvantage, of having a part of the withdrawing device put into the bag in conjunction with the flowable material, is avoided.

In order to achieve a rapid adhering of the members to the bag wall, the annular sealing surfaces preferably comprise a pressure-sensitive adhesive coating which prior to use is covered by a removable protective liner.

The separating means should be relatively sharp and mechanically stable to safely cut through both bag walls. In case plastic material is selected, the suitable material may be relatively hard and thus provides an extremely small cutting extension, and yet establish a safe snap connection. In any case, it has to be avoided that the snap connection is released. If the material is poured out of the bag, considerable pressures might occur particularly if additional aids are applied so that the contents of the bag is subject to a higher pressure. The snap connection between the members should resist these higher pressures.

Various known snap connections can be applied to plug the annular socket member and punch-like separating member of the device together according to the invention.

BRIEF DESCRIPTION OF THE DRAWING

Embodiments of the invention will be described in more detail in connection with the accompanying drawings, wherein.

DETAILED DESCRIPTION OF THE INVENTION

Figure 1:
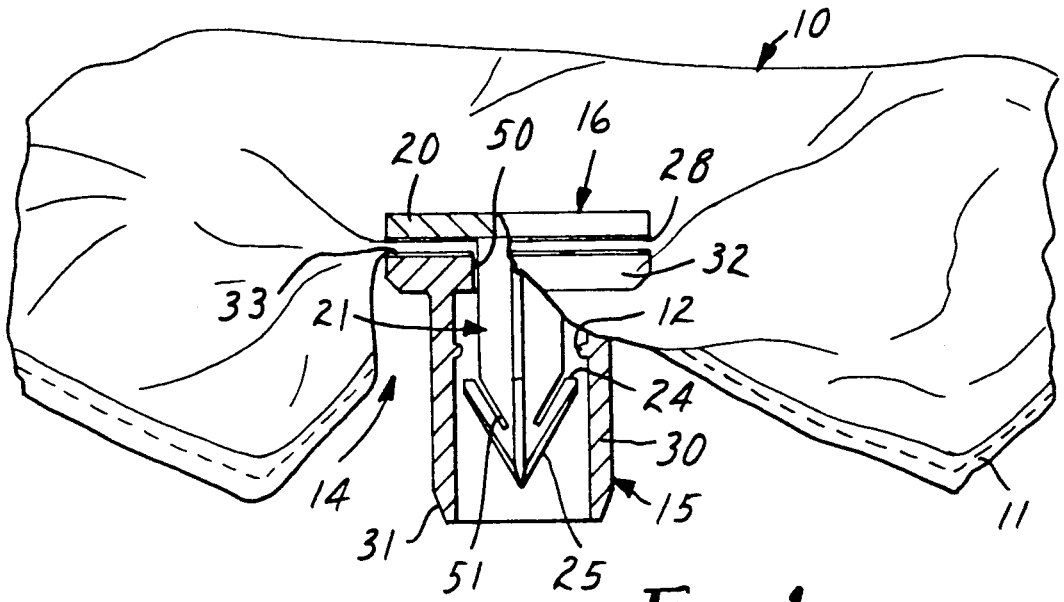
FIG. 1 shows a side view of a bag and device according to the present invention, partially in cross section, after application of the device to the bag.

A bag 10 is made of plastic sheet material which is sealed at margins 11. The bag 10 contains a flowable substance, e.g. a liquid resin. A withdrawing device 14 is applied to bag 10 which consists of a first member 15 and a second member 16. The members 15 and 16 are subsequently explained by means of FIGS. 3 to 5.

Figure 3:
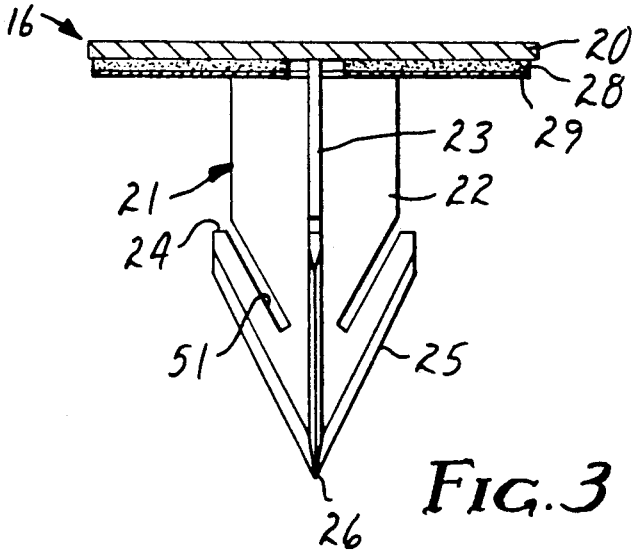
FIG. 3 shows a side view, partially in vertical section in larger scale, of the punch-like second member of the device of FIG. 1.
Figure 5:
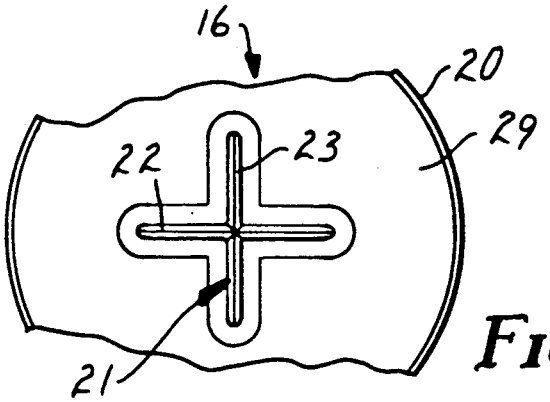
FIG. 5 shows a fragmentary bottom view of the member of FIG. 3.
Figure 6:
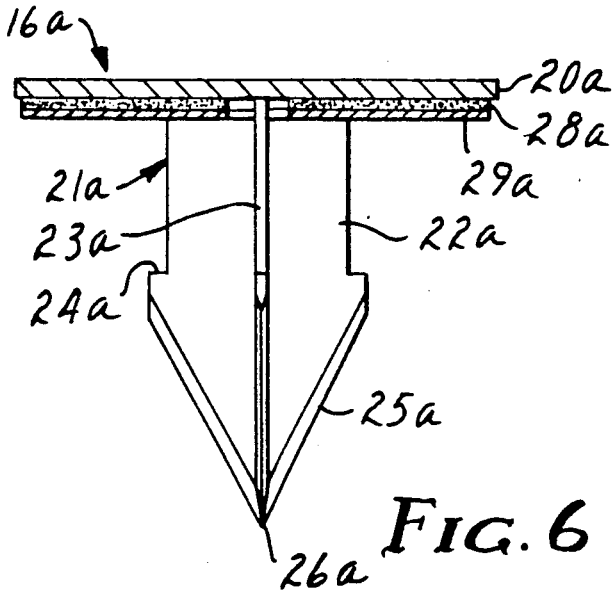
FIG. 6 shows a side view, partially in vertical section, of a modified second member.
Figure 7:
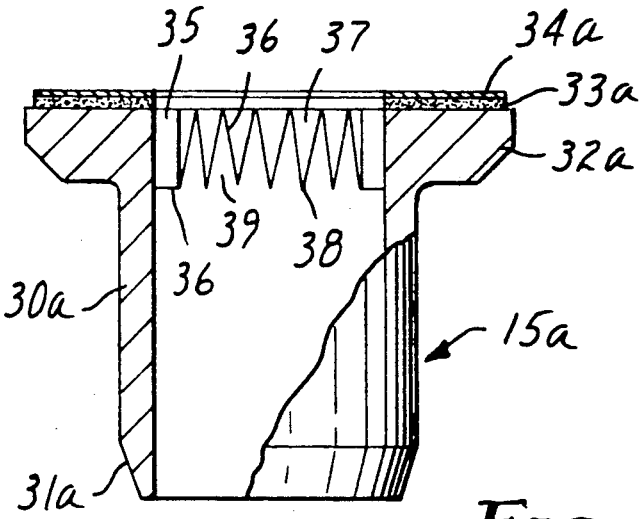
FIG. 7 shows a side view, partially in vertical section, of a modified first member.
Figure 8:
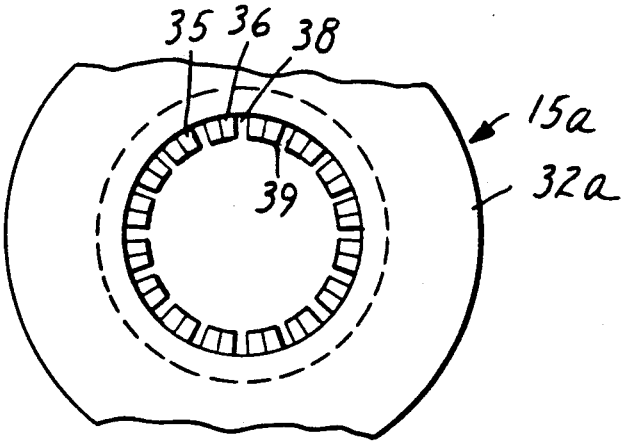
FIG. 8 shows a fragmentary plan view of the member of FIG. 7.

The member 16, illustrated in FIGS. 3 and 5, includes a flat head 20 to which a punch portion 21 is integrally joined. The punch portion consists of perpendicularly crossing webs 22, 23 x-shaped in plan having a radially outwardly extending shoulder 24. Below the shoulders 24, the outer edges of the webs 22, 23 are formed as cutting edges 25 intersecting at the free end of the punch portion 21 at 26. A pressure-sensitive adhesive layer 28 is coated on the lower side of head 20, and is spaced a distance from the webs 22, 23 as can be seen in FIG. 5. The adhesive layer 28 is covered by a removable protective liner 29.

A slot 51 extends from the shoulders 24 of member 16 parallel to the cutting edges 25, whereby the portions including the cutting edges 25 can be deformed radially inwardly.

The integrally formed member 16 is made of a suitable plastic material having a hardness sufficient for the sharp and mechanically stable cutting edges 25 to pierce and cut the bag side walls.

Figure 4:
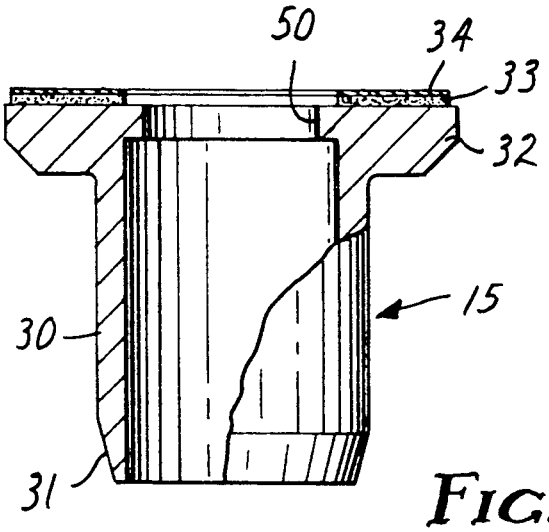
FIG. 4 shows a side view, partially in vertical section in a larger scale, of the first member of the device of FIG. 1.

The member 15, shown in FIG. 4, includes a sleeve portion 30 which conically tapers at the free end at 31. A radial flange 32 is formed at the opposite end. A pressure sensitive layer 33 is applied to flange 32 which is covered by a removable protective liner 34. At the upper end of member 15, a bore portion 50 of reduced diameter is provided. Upon engaging the bore portion 50, the cutting edges 25 of member 16 can be radially inwardly deflected. Thereafter, the shoulders 24 snap behind the step formed by the bore portion 50 so that member 16 cannot be retracted from member 15.

If applied, the members 15, 16 of the withdrawing device are freed first from the protective films 29 and 34 of the pressure-sensitive adhesive layers 28 and 33. Subsequently, member 15 is adhered to the outer side of a bag wall. The punch portion 21 of member 16 is then pierced from the opposite side through both bag walls and inserted into member 15 in a manner described above. The member 16 is plugged into member 15 as far as necessary to adhere the adhesive layer 28 to the associated outer side or surface of the bag wall. If an opposite respective pressure is applied, the members 15, 16, and the bag walls, are moved away from each other, and the material within the bag can then flow through the passage between the punch portion 21 and bore 50, and the throughbore of sleeve portion 30 as indicated by arrows 42 in FIG. 2. The four cutting edges 25 of punch portion 21 effect a cross cut in the bag walls whereby four triangular flaps are formed which are bent into the passage when the material is poured out as can be seen at 43. The shoulders 24 prevent the punch portion 21 from being retracted from the first member 15.

In the embodiment shown in FIGS. 6 to 10, the parts, equal to those of the embodiment described above, are provided with the same reference numbers to which an "a" is added.

Tongues 36 are formed at the upper end of the throughbore of member **15*a* at 35. The tongues are arranged in pairs such that a downwardly extending V-shaped slot 37 is formed having its most narrow portion at 38. Inversely V-shaped indentations 39 are formed between adjacent tongues 36. The number of slots 37 is such that a cross formed by the cutting edges 25*a* of member 16*a* can be plugged or plunged through the slots 37 if the cutting edges 25*a* are aligned to the axis of four slots 37 circumferentially spaced about 90°. Since the width of the cutting edges 25*a* or of the webs 22*a*, 23*a*, respectively, is somewhat larger than the most narrow across section 38 of slots 37, the flexible tongues 36 are slightly deformed. When the punch portion 21*a* has been inserted far enough for the shoulders 24*a* to pass the constriction 38, the tongues 36 return to their normal position, whereby the punch portion 21*a* is prevented from being retracted. On the contrary, if a retraction force is applied to member 16*a*, the shoulders 24*a* move into the inversely V-shaped indentations 39 whereby the punch portion 21*a* is non-releasably connected with member 15*a*. This can be seen in FIGS. 9 and 10 wherein the plugging together of members 15*a* and 16*a*** is illustrated.

Figure 9:
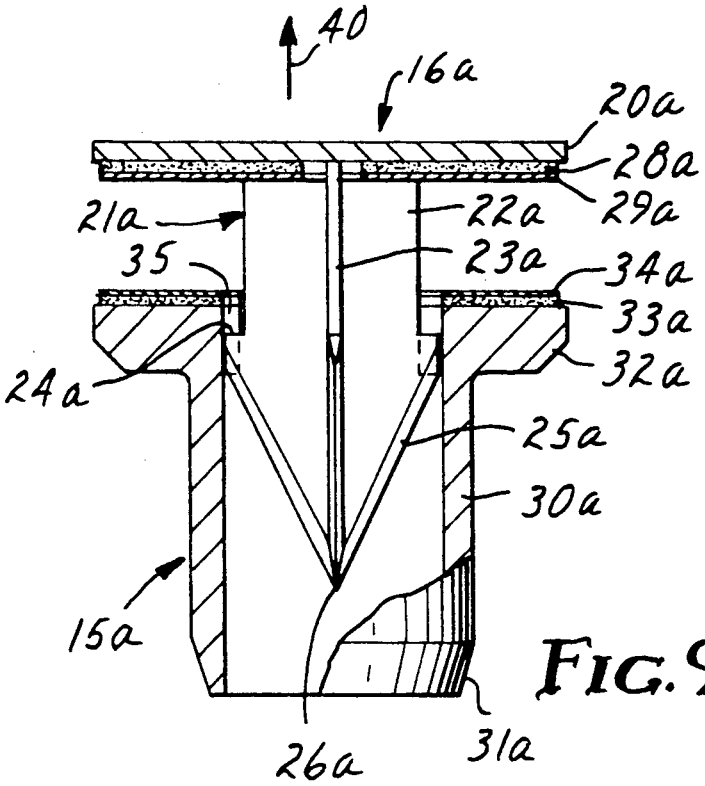
FIG. 9 shows a side view, partially in cross section, of the members of the FIGS. 6 and 7 mounted together at a first relative position.
Figure 10:
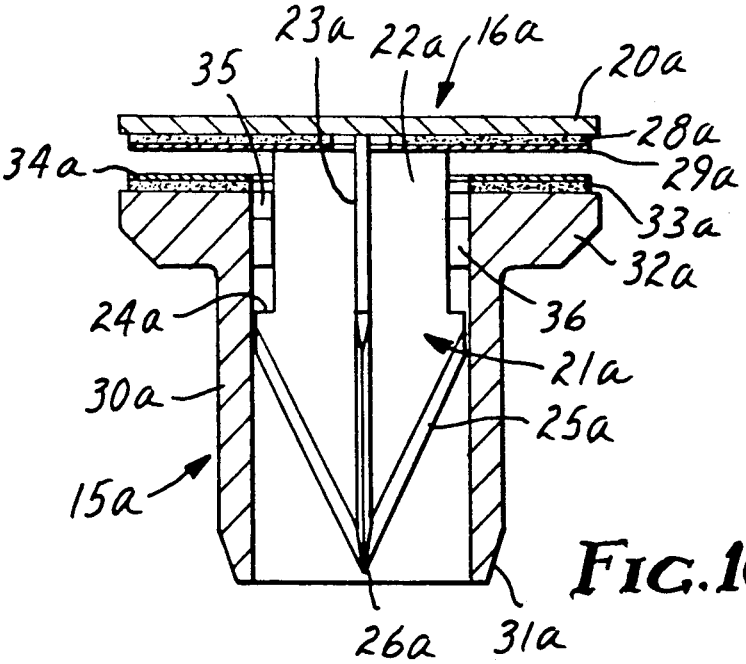
FIG. 10 shows a vertical sectional view of the members illustrated in FIG. 9, with the members in a second relative position.

In FIG. 10, it can be seen that the punch portion **21*a* is plugged into the throughbore of sleeve portion 30*a* a certain extent. If retracted toward direction 40 as shown in FIG. 9, the shoulders 24*a* enter the indentations 39 of adjacent flexible tongues 36 and engage the joint 35 of tongues 36**. Further retraction is prevented.

It can be seen further that a passage is defined between the bore wall of sleeve portion **30*a* and the webs 22*a*, 23*a* of punch portion 21*a*. The flowable material can flow through the passageways and sleeve portion 30*a***.

The interlocking of members **15*a*, 16*a* shown in FIGS. 6 to 10 is achieved by a suitable snap connection. In the snap connection, the punch portion 21*a* is formed as a rigid part while member 15*a* has resilient portions (tongues 36). In the embodiment according to FIGS. 1 to 4, the punch-like member 16 is provided with resilient portions. It is understood also that other suitable snap connections can be used. Furthermore, the shape of the punch portions 21, 21*a*** can be modified. For example, an annular cutting edge can be used rather than a cross defined by the cutting edges.

If, for example, the bag is not completely emptied, the members 15, 16 can telescope into one another as shown in FIG. 1 so that the passage for the flowable material is interrupted. In order to maintain this closed position, an inner projection 12 can be formed in the bore of member 15 which forms a snap connection with the shoulder 24 of member 16 which can be easily released.

Figure 11:
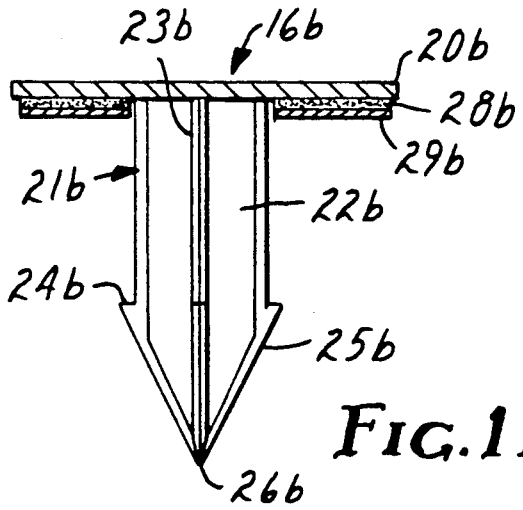
FIG. 11 shows a side view of a modified embodiment of the second member of the device according to the invention.

The member **16*b* shown in FIG. 11 deviates from that shown in FIG. 3 in that the webs 22*b*, 23*b* are thin and are shaped as rods projecting from the head 20***b*. The webs or rods 22*b*, 23*b* are joined at a tip 26*b*. Therefore, webs 22*b*, 23*b* can be limitedly deformed radially to be inserted for example in a member 15 shown in the FIGS. 1, 2 or 4 and to form a snap connection therewith.

Figure 12:
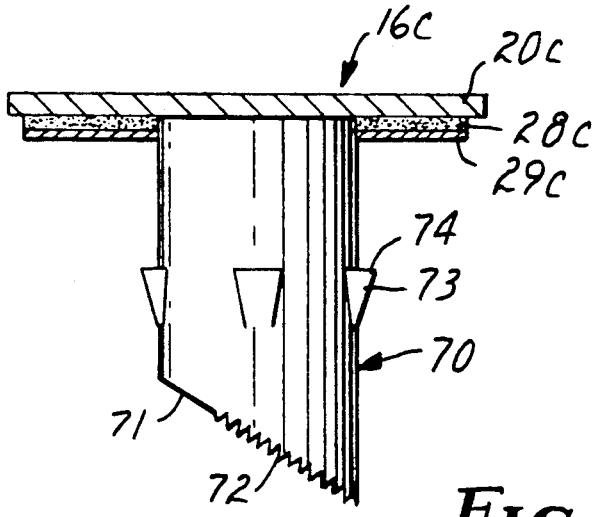
FIG. 12 shows a further modified embodiment of the second member of the device according to the invention.

FIG. 12 shows a punch-like member 16*c* having a flat head 20*c* provided with an adhesive layer 28*c* at the lower side thereof covered by a removable protective liner 29*c*. A tube-like punch portion 70 is integrally formed to head 20*c*, the free end thereof being chamfered at 71. The chamfer 71 includes teeth 72 about a major portion of its circumference. It serves to make a cut through the bag walls. The punch portion 70 includes four circumferentially equally spaced tongues 73 between its ends which are joined to the punch portion 70 with their lower ends and which are radially movable. The upper ends 74 of tongues 73 form shoulders which for example may cooperate with a member 15 of FIG. 4 to lock the punch-like member 16*b* after the bag walls have been pierced through.

Figure 2:
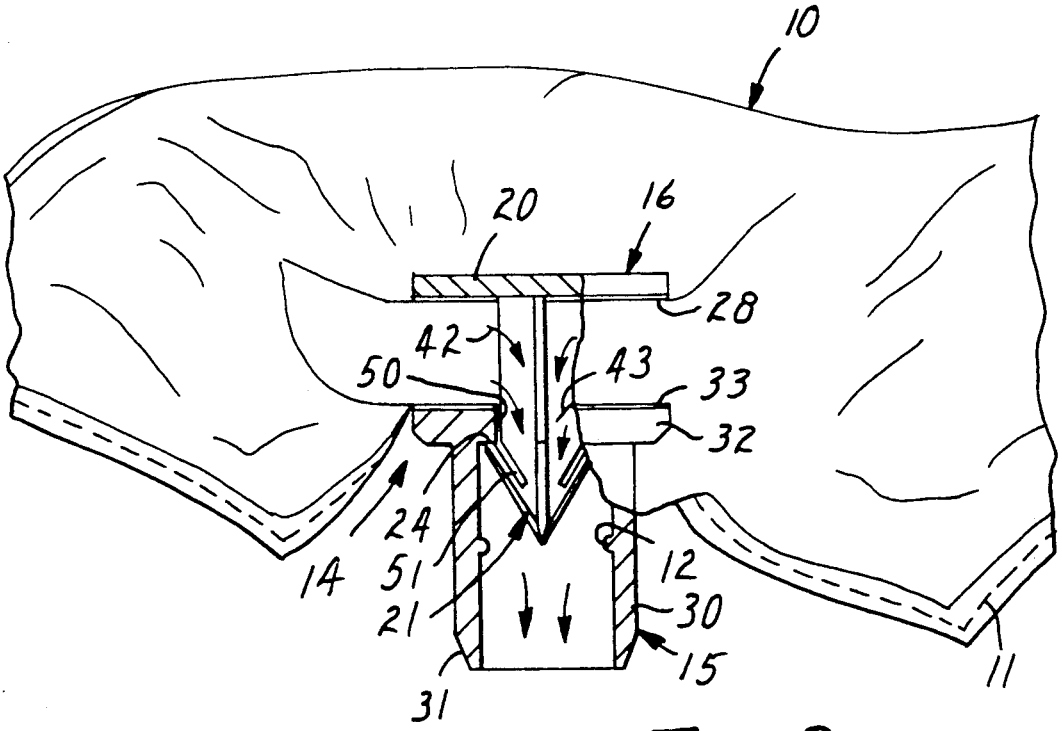
FIG. 2 shows a similar view as FIG. 1 with the device illustrated in flowable material withdrawing position.
Figure 13:
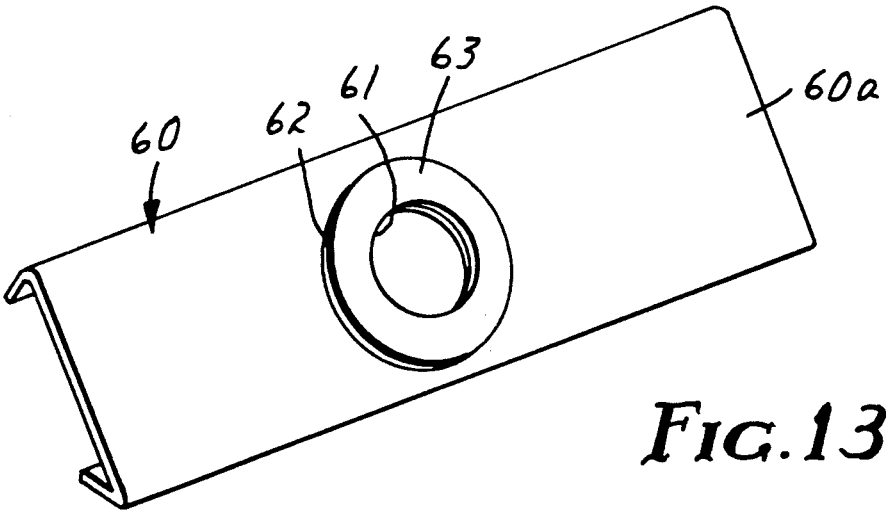
FIG. 13 shows a perspective view of a further modified embodiment of the first member.

By means of the withdrawing device described, for example as shown with a bag 10 in FIGS. 1 and 2, the contents can be directly discharged into a container. To this purpose, the container has to have an opening which is suited to form a snap connection with member 16, 16*a*, 16*b*, 16*c*, respectively, in the manner described above. In FIG. 13, a rail 60 is shown having a dove-tail cross section, the web 60*a* of rail 60 having a circular opening 61. A pressure sensitive layer 62 is applied to the web of rail 60 around opening 61 which layer is protected by a release liner 63. Rail 60 for example serves for the closing of a slitted sleeve (not shown) for a cable connection. By means of a member 16, 16*a*, 16*b* or 16*c*, respectively, as shown in some Figures, the contents of a bag 10, e.g. cast resin, can be filled into the sleeve directly.

It is understood that an opening 61 with a respective adhesive layer can be provided also in connection with other containers. For these cases, it is appropriate that the resiliently deformable portions, for the snap connection, are associated with the punch portion rather than with the opening 61.

For the last mentioned embodiment, it can be appropriate to remove the bag from the container or the rail 60. This can be achieved for example by tearing off the bag from the head of members 15, 16 by releasing the adhesive connection. To this purpose the bag can also be released by having respective weakening lines.

I claim:

1. A device for withdrawing flowable material through a wall of a bag having flexible walls, comprising a first member having a throughbore and an annular sealing surface surrounding said throughbore, a second member having an annular sealing surface and separating means radially inwardly of said sealing surface for cutting a bag wall, said first and said second member including cooperating locking means for forming an interlocking engagement when the separating means makes two cuts through the wall of a bag, said annular sealing surfaces each being brought into sealing engagement with an outer surface of the wall of a bag, with said annular sealing surfaces being attached to the outer wall surface by adhesion, said separating means of said second member being formed with a punch-like portion such that the wall of a bag is pierced through twice prior to said separating means entering said throughbore of said first member to form a passage for said flowable material, said punch-like portion of said second member and said throughbore of said first member being adapted for said interlocking engagement, such that said first and said second member are movable relative to each other in the direction opposite to the piercing direction of said separating means.

2. The device according to claim 1, wherein at least one of said annular sealing surfaces is provided with a pressure-sensitive adhesive layer which is covered by a protective liner prior to use.

3. The device according to claim 1, wherein said first member is provided with a hollow sleeve portion aligned with said throughbore.

4. The device according to claim 1, wherein said first member is formed as a fitting for a container.

5. The device of claim 1, wherein said first element is formed as a container having an upper opening forming said throughbore.

6. The device according to claim 1, wherein said separating means include two cutting edges arranged at an angle of 180°.

7. The device of one of the claims 1, wherein said separating means include at least two cutting edges arranged at an angle less than 180°.

8. The device of claim 7, wherein three or more of said cutting edges are arranged star-like.

9. The device of claim 6, wherein said cutting edges are wedge-shaped and converge away from said annular sealing surface.

10. The device of claim 1, wherein said separating means include a hollow tube-like punch-like portion having a cutting edge partially extending around the free end thereof which preferably is obliquely arranged with respect to the axis of said punch-like portion.

11. The device of claim 1, wherein said separating means punch-like portion, includes at least one resiliently deformable locking portion which is deformed if inserted into said throughbore and snaps lockingly behind an undercut formed around said throughbore.

12. The device of claim 1, wherein said separating means punch-like portion and said first member include means to form a bayonet lock for holding the members together.

13. The device of claim 6, wherein said throughbore has a portion, the wall thereof having alternating slots and projections, the arrangement of said slots is selected such that upon respective orientation of said cutting edges of said separating means being moved through said slots, and wherein shoulders are formed above said cutting edges, and said projections have indentations at the rear side thereof to cooperate with said shoulders to form said interlocking engagement.

14. The device of claim 13, wherein said indentations are triangular with an opening to the indentation being at the widest end thereof and the farthest distance from the throughbore.

15. The device of claim 13, wherein the cuts between said projections taper toward the piercing direction.

16. The device of claim 15, wherein said projections are formed as flexible tongues, the free ends thereof having a distance from each other smaller than the width of the webs including said cutting edges.

17. The device of claim 1, wherein said punch-like portion and a portion of said throughbore of said first member include means for forming an easily releasable snap connection retaining said members in a closed position wherein the walls of a bag are interposed between the head portions of said members and engage each other.

* * * * *